US009790565B2

(12) United States Patent
Chae et al.

(10) Patent No.: US 9,790,565 B2
(45) Date of Patent: Oct. 17, 2017

(54) HOT-ROLLED STAINLESS STEEL SHEET HAVING EXCELLENT HARDNESS AND LOW-TEMPERATURE IMPACT PROPERTIES

(71) Applicant: POSCO, Pohang-si (KR)

(72) Inventors: Dong Chul Chae, Gwangyang-si (KR); Gyu Jin Jo, Gwangyang-si (KR); Jae Hwa Lee, Gwangyang-si (KR); Kwang Yuk Kim, Gwangyang-si (KR)

(73) Assignee: POSCO, Pohang-si (KR)

( * ) Notice: Subject to any disclaimer, the term of this patent is extended or adjusted under 35 U.S.C. 154(b) by 220 days.

(21) Appl. No.: 14/653,944

(22) PCT Filed: Dec. 27, 2012

(86) PCT No.: PCT/KR2012/011651

§ 371 (c)(1),
(2) Date: Jun. 19, 2015

(87) PCT Pub. No.: WO2014/098301

PCT Pub. Date: Jun. 26, 2014

(65) Prior Publication Data

US 2015/0315686 A1 Nov. 5, 2015

(30) Foreign Application Priority Data

Dec. 21, 2012 (KR) ..... 10-2012-0151264

(51) Int. Cl.

| | |
|---|---|
| ***C21D 8/02*** | (2006.01) |
| ***C21D 7/13*** | (2006.01) |
| ***C22C 38/04*** | (2006.01) |
| ***C22C 38/02*** | (2006.01) |
| ***C22C 38/00*** | (2006.01) |
| ***C21D 9/46*** | (2006.01) |
| ***C22C 38/58*** | (2006.01) |
| ***C22C 38/40*** | (2006.01) |
| ***C22C 38/44*** | (2006.01) |
| ***C22C 38/48*** | (2006.01) |
| ***C22C 38/50*** | (2006.01) |
| ***C21D 6/00*** | (2006.01) |

(52) U.S. Cl.

CPC ..... *C21D 8/02* (2013.01); *C21D 6/004* (2013.01); *C21D 7/13* (2013.01); *C21D 9/46* (2013.01); *C22C 38/001* (2013.01); *C22C 38/02* (2013.01); *C22C 38/04* (2013.01); *C22C 38/40* (2013.01); *C22C 38/44* (2013.01); *C22C 38/48* (2013.01); *C22C 38/50* (2013.01); *C22C 38/58* (2013.01); *C21D 2211/005* (2013.01); *C21D 2211/008* (2013.01)

(58) Field of Classification Search

CPC . C21D 6/004; C21D 7/13; C21D 8/02; C21D 9/46; C21D 2211/005; C21D 2211/008; C22C 38/001; C22C 38/02; C22C 38/04; C22C 38/40; C22C 38/44; C22C 38/48; C22C 38/50; C22C 38/58

See application file for complete search history.

(56) References Cited

U.S. PATENT DOCUMENTS

| | | | | |
|---|---|---|---|---|
| 4,608,099 | A | 8/1986 | Davison et al. | |
| 2006/0113008 | A1* | 6/2006 | Hirasawa ..... | C22C 38/001 148/325 |
| 2007/0170226 | A1 | 7/2007 | Ono et al. | |

FOREIGN PATENT DOCUMENTS

| | | |
|---|---|---|
| CA | 2781052 | 5/2011 |
| EP | 1621644 | 2/2006 |
| KR | 1020050107595 | 11/2005 |
| KR | 1020100058852 | 6/2010 |
| KR | 1020100073825 | 7/2010 |
| KR | 1020120126112 | 11/2012 |

OTHER PUBLICATIONS

Canadian Office Action—Canadian Application No. 2,895,971 dated Oct. 13, 2016, citing EP 1621644 and CA 2781052.
International Search Report—PCT/KR2012/011651 dated Jun. 27, 2013.

* cited by examiner

*Primary Examiner* — Roy King
*Assistant Examiner* — Caitlin Kiechle
(74) *Attorney, Agent, or Firm* — Cantor Colburn LLP

(57) ABSTRACT

A hot-rolled stainless steel sheet having excellent hardness and low-temperature impact properties, in which a ferrite is formed with martensite as a matrix structure, is manufactured by a steel manufacturing process, a continuous casting process, and a hot-rolling process. The hot-rolled stainless steel sheet comprises C, N, Si, Mn, Cr, Ni, Ti, Nb, Mo, and the remainder being Fe and other inevitable impurities, wherein C is 0.01 to 0.03 wt %, Cr is 11 to 14 wt %, Ti is 0.1 to 0.2 wt %, and Nb is 0.1 to 0.2 wt %. The ferrite stability (FS) expressed by the following [formula 1] is 5 to 50, and a ferrite is formed with martensite as a matrix structure. [Formula 1] $4\ FS=-215-619C-16.6Mn+23.7Cr-36.8Ni+42.2Mo+96.2Ti+67Nb-237N+17.2Si$, wherein the numerical value of each component described in [Formula 1] denotes the content (wt %) of each component.

4 Claims, 5 Drawing Sheets

| Sample | Classification | Impact Specimen | |
|---|---|---|---|
| | | T(Transverse) | L(Longitudunal) |
| #10 | Comparative Example |  |  |
| #11 | Example |  |  |
| #12 | Example |  |  |

| Sample | Classification | Ferrite Fraction (%) | Microstructure | |
|---|---|---|---|---|
| | | | LS plane | TS plane |
| #10 | Comparative Example | 8 |  |  |
| #11 | Example | 20 |  |  |
| #12 | Example | 37 |  |  |

HOT-ROLLED STAINLESS STEEL SHEET HAVING EXCELLENT HARDNESS AND LOW-TEMPERATURE IMPACT PROPERTIES

TECHNICAL FIELD

The present invention relates to a hot-rolled stainless steel sheet having excellent hardness and low-temperature impact properties, and more particularly to a hot-rolled stainless steel sheet having excellent hardness and low-temperature impact properties, comprising a martensitic matrix structure and a ferrite phase.

BACKGROUND ART

Recently, stainless steel for wear-resistance applications is receiving attention in industrial fields as an alternative to high-strength carbon steel. The reason why attention is paid to wear-resistant stainless steel is that high-strength carbon steel has to be frequently replaced because of the poor corrosion resistance thereof. Particularly in the oil sands industry, the demand for wear-resistant material suitable for the purification and transport of oil sands is increasing. Such wear-resistant stainless steel for industrial equipment should typically have high hardness, and should be resistant to intergranular corrosion at welds. Furthermore, minimum impact properties are required to ensure equipment stability.

Generally, stainless steels are classified depending on the chemical components or the metal structure thereof. Depending on the metal structure, stainless steels are classified into austenitic (300 series), ferritic (400 series), martensitic, and duplex stainless steels.

Among these stainless steels, ferritic (400 series) stainless steels have superior processability and corrosion resistance. In particular, 410 series steel is composed mainly of 0.15 wt % or less of C and 11 to 13 wt % of Cr. The use of high C content is advantageous because high hardness may be obtained through thermal treatment. However, 410 series steel is disadvantageous because the base material and welds have poor low-temperature impact properties, and also because intergranular corrosion is very severe at welds due to the absence of stabilizing elements such as Ti or Nb to ensure high hardness.

Hence, there is the need for wear-resistant material having superior impact properties and sufficiently high hardness, despite containing stabilizing elements, in order to apply it to wear-resistant equipment.

Currently widely available as stainless steel containing low Cr (11 to 13%) with superior impact properties at welds is 3Cr12 steel, containing 11.5% of Cr with Ti. 3Cr12 steel is configured such that about 0.025% C-11.5% Cr is added with small amounts of Ni and Mn, and thus the heat affected zone of welds has a dual phase of ferrite and martensite, to thereby improve impact properties of welds.

In particular, U.S. Pat. No. 4,608,099 (Patent Document 1) discloses steel in which Ti is removed from 3Cr12 steel and Mo is added in an amount of 0.2 to 0.5% to further improve the impact properties of the base material of 3Cr12 steel. The steel disclosed in Patent Document 1 is used through thermal treatment at an annealing temperature of 670 to 730° C., and thus exhibits a yield strength of 303 to 450 MPa and a tensile strength of 455 to 600 MPa, ultimately resulting in high strength compared to typical ferritic stainless steel. However, this steel has low softness and is thus unsuitable for use in wear-resistance applications. Such steels manifest low Brinell hardness of about 140 to 180 HB, and are thus inappropriate for wear-resistance applications. Moreover, there are problems with low corrosion resistance because of the precipitation of Cr-carbide in the heat affected zone of welds, attributable to the absence of stabilizing elements such as C and N.

CITATION LIST

Patent Literature (Patent Document 1) U.S. Pat. No. 4,608,099 (Aug. 26, 1986)

DISCLOSURE

Technical Problem

Accordingly, the present invention is intended to provide a hot-rolled stainless steel sheet, which has a high hardness of 250 HB or more, and contains stabilizing elements to exhibit superior corrosion resistance and low-temperature impact properties, and is thus suitable for use in wear-resistant equipment.

In particular, the present invention is intended to provide a hot-rolled stainless steel sheet, in which low-temperature impact properties may be ensured by controlling the alloy composition having a high ferrite fraction and by controlling the anisotropy of ferrite.

Technical Solution

An embodiment of the present invention provides a hot-rolled stainless steel sheet having excellent hardness and low-temperature impact properties, which is manufactured by steel making, continuous casting and hot rolling, comprising: 0.01 to 0.03 wt % of C, 11 to 14 wt % of Cr, 0.1 to 0.2 wt % of Ti, 0.1 to 0.2 wt % of Nb, 0.01 to 0.03 wt % of N, 0.2 to 0.5 wt % of Si, 0.2 to 2.0 wt % of Mn, 1.0 to 2.0 wt % of Ni, and 0.1 to 0.5 wt % of Mo, wherein a sum of amounts of C and N is 0.02 to 0.05 wt %, and a sum of amounts of Ti and Nb is 0.2 to 0.3 wt %, and the hot-rolled stainless steel sheet has a ferrite stability (FS) ranging from 5 to 50 as represented by [Equation 1] below, and comprises a martensitic matrix structure and a ferrite phase:

$$FS=-215-619C-16.6Mn+23.7Cr-36.8Ni+42.2Mo+96.2Ti+67Nb-237N+17.2Si \quad \text{[Equation 1]}$$

in [Equation 1], numerical values of individual components denote amounts (wt %) of the corresponding components.

The hot-rolled stainless steel sheet may have a Brinell hardness of 250 HB or more in a hot-rolled condition.

In the hot-rolled stainless steel sheet, both an impact value (0° C.) measured in a longitudinal (L) direction, parallel to a rolling direction (RD), and an impact value (0° C.) measured in a long transverse (T) direction, perpendicular to the rolling direction (RD) in a horizontal plane, may be 20 J or more.

In the hot-rolled stainless steel sheet, the impact value (0° C.) measured in a longitudinal (L) direction may be higher by 5 J or more than the impact value (0° C.) measured in a long transverse (T) direction.

The TS plane of the hot-rolled stainless steel sheet, defined by a long transverse (T) direction and a short transverse (S) direction perpendicular to the long transverse (T) direction in a vertical plane, may have a degree of microstructural banding ($\Omega_{12}$) ranging from 0.60 to 0.80 as measured by ASTM E1268-01.

The ferrite phase may be provided in a network form.

Advantageous Effects

According to embodiments of the present invention, a hot-rolled stainless steel sheet, comprising a martensitic matrix structure, has the ferrite stability (FS) controlled in an appropriate range so as to attain a high ferrite fraction, thereby ensuring low-temperature impact properties while maintaining sufficient hardness.

Also, upon hot rolling of the hot-rolled stainless steel sheet, the degrees of microstructural banding for the planes in a rolling direction and a direction perpendicular to the rolling direction are adjusted, whereby the anisotropy of ferrite is controlled, thus ensuring that low-temperature impact properties are attained while maintaining sufficient hardness.

Therefore, the hot-rolled stainless steel sheet can be economically applied to industrial equipment requiring corrosion resistance and wear resistance, both of base material and welds, and can also be used in place of high-strength carbon steel, which has to be frequently replaced due to corrosion resistance problems, ultimately reducing the material cost. In particular, this sheet can exhibit superior low-temperature impact resistance despite having a high hardness, and is thus suitable for wear-resistance applications in the winter season.

BEST MODE

Figure 1A:
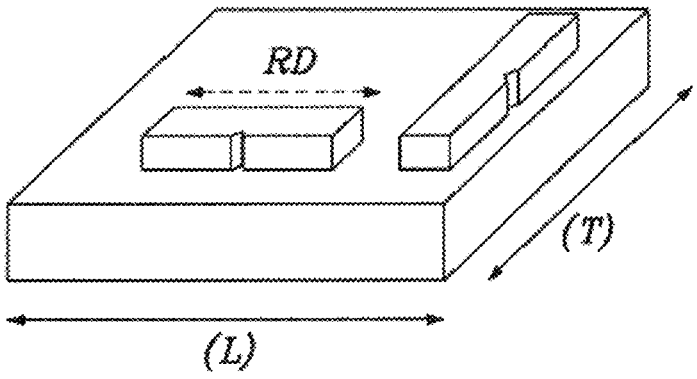
FIG. 1*a* illustrates the impact specimen in different directions.

Hereinafter, a detailed description will be given of embodiments of the present invention with reference to the appended drawings. However, the present invention is not limited to the following embodiments, which may be changed in various forms. These embodiments are provided to complete the disclosure of the present invention, and to fully describe the present invention to those skilled in the art.

The present invention addresses a hot-rolled stainless steel sheet comprising a martensitic matrix structure and a ferrite phase, comprising: 0.01 to 0.03 wt % of C, 0.01 to 0.03 wt % of N, 0.2 to 0.5 wt % of Si, 0.2 to 2.0 wt % of Mn, 11 to 14 wt % of Cr, 1.0 to 2.0 wt % of Ni, 0.1 to 0.2 wt % of Ti, 0.1 to 0.2 wt % of Nb, and 0.1 to 0.5 wt % of Mo, with the remainder of Fe and inevitable impurities.

In particular, the sum of the amounts of C and N is set to 0.02 to 0.05 wt %, and the sum of the amounts of Ti and Nb is set to 0.2 to 0.3 wt %.

As the amounts of C and N are increased, hardness may be enhanced, but impact properties of welds cannot be ensured. Hence, the upper limit of each of these elements is preferably limited to 0.01 to 0.03 wt % (hereinafter simply referred to as "%").

In particular, the sum of two elements, C+N, is adjusted to 0.05% or less. If the amount of C+N exceeds 0.05%, the low-temperature impact properties of the material and the toughness of the martensite formed in welds may drastically deteriorate.

Si, serving as a deoxidizer, is added in an amount of 0.2% or more to reduce the amount of inclusions in steel. In particular, the amount thereof is preferably maintained at 0.5% or less to prevent the toughness of welds from decreasing.

Mn is used as an austenite forming element. If the amount thereof is less than 0.2%, the effect of improving the toughness of welds may become insignificant. In contrast, if the amount thereof exceeds 2.0%, the toughness of the steel material may be drastically decreased. Hence, the amount of Mn preferably falls in the range of 0.2 to 2.0%.

Cr is used in an amount of 11.0% or more, which is necessary in order to ensure corrosion resistance. If Cr, which is a ferrite forming element, is added in an amount exceeding 14.0%, an excess of ferrite may be introduced into the martensitic matrix structure in the hot-rolled condition, undesirably decreasing hardness. Hence, the amount of Cr preferably falls in the range of 11.0 to 14.0%.

Ni, which is an austenite forming element, contributes to increasing the toughness of base material. In particular, this element is responsible for enhancing the toughness of welds upon welding. Accordingly, in order to improve low-temperature impact toughness, the amount of Ni is limited to 1% or more. The excessive addition of expensive Ni may increase the material cost. Hence, the upper limit thereof is preferably maintained at 2.0% or less.

Ti and Nb are used to form carbonitride. When used for welded structural products, these elements are effective at increasing the strength and corrosion resistance of welds. However, if Ti and Nb are added in excessively small or large amounts, the toughness and ductility of the material may decrease. In particular, if Ti is excessively added in an amount of 0.2% or more, notable surface defects may be caused by oxides when casting. Furthermore, if Ti and Nb are excessively added, low-temperature impact toughness is considerably decreased. Therefore, to ensure the corrosion resistance of welds and to prevent the low-temperature impact toughness of base material from drastically decreasing, the amount of each of Ti and Nb is maintained in the range of 0.1 to 0.2%. As such, the sum of these two elements, Ti+Nb, preferably falls in the range of 0.2 to 0.3%.

Mo is used to increase the pitting resistance of the material so as to enhance the corrosion resistance. Since Mn is very expensive, the amount thereof is preferably maintained in the range of 0.5% or less but exceeding 0.01%.

In the present invention, the alloy composition is controlled to estimate the ferrite (1200° C.) fraction in order to ensure low-temperature impact properties. In the hot-rolled stainless steel sheet according to the present invention, the composition range of the alloy components is preferably controlled so that the ferrite stability (FS), which expresses the composition range of the alloy components as a function, as represented by [Equation 1] below, falls in the range of 5 to 50.

$$FS=-215-619C-16.6Mn+23.7Cr-36.8Ni+42.2Mo+96.2Ti+67Nb-237N+17.2Si \quad \text{[Equation 1]}$$

In [Equation 1], the numerical values of individual components denote the amounts (wt %) of the corresponding components.

High ferrite stability (FS) means that the volume fraction of the ferrite structure is increased. Also, as the volume fraction of the ferrite structure is increased, the low-temperature impact toughness (0° C.) is proportionally improved. Thus, the ferrite stability (FS) is adjusted to fall within the range of 5 to 50 in the present invention, whereby high hardness is maintained and low-temperature impact toughness can be ensured as desired. The reason why the ferrite stability (FS) is set within the range from 5 to 50 is described through the following examples.

In the present invention, the hot-rolled stainless steel sheet having excellent hardness and low-temperature impact properties is manufactured by preparing molten steel having the above composition, which is then subjected to continuous casting, hot rolling and then air cooling.

EXAMPLES

Below is a description of examples of the present invention.

Each of the twelve steel compositions shown in [Table 1] below was cast into an ingot weighing 50 kg having a thickness of about 140 mm in a vacuum induction melting furnace. The cast ingot was aged in a heating furnace at 1240° C. for 3 hr and then hot-rolled to a thickness of 12 mm. This hot rolling process was terminated at a temperature of 900° C. or more, after which air cooling was implemented.

Also, the values of ferrite stability (FS) for individual steels are shown in [Table 1] below.

TABLE 1

| | Alloy elements | | | | | | | | | | |
|---|---|---|---|---|---|---|---|---|---|---|---|
| # | C | Mn | Cr | Ni | Mo | Ti | Nb | N | Si | FS | Note |
| 1 | 0.031 | 1.8 | 11.5 | 0.8 | 0.25 | — | — | 0.035 | 0.40 | −12 | Comparative Example |
| 2 | 0.027 | 1.4 | 11.6 | 1.2 | 0.25 | 0.05 | — | 0.015 | 0.38 | −6 | Comparative Example |
| 3 | 0.019 | 1.4 | 11.4 | 1.2 | — | 0.22 | — | 0.016 | 0.39 | 0 | Comparative Example |
| 4 | 0.019 | 1.4 | 11.5 | 1.2 | — | — | 0.31 | 0.015 | 0.38 | 2 | Comparative Example |
| 5 | 0.025 | 1.4 | 11.5 | 1.8 | 0.25 | 0.11 | 0.05 | 0.016 | 0.40 | −20 | Comparative Example |
| 6 | 0.027 | 1.4 | 11.7 | 1.2 | 0.26 | 0.16 | 0.11 | 0.016 | 0.39 | 15 | Example |
| 7 | 0.012 | 1.4 | 11.9 | 1.3 | — | 0.13 | 0.13 | 0.011 | 0.39 | 14 | Example |
| 8 | 0.011 | 1.9 | 12.0 | 1.4 | — | 0.13 | 0.15 | 0.011 | 0.40 | 6 | Example |
| 9 | 0.013 | 1.2 | 12.4 | 1.7 | — | 0.11 | 0.17 | 0.013 | 0.38 | 14 | Example |
| 10 | 0.028 | 0.3 | 11.5 | 1.8 | — | 0.17 | 0.10 | 0.015 | 0.39 | −5 | Comparative Example |
| 11 | 0.025 | 0.3 | 12.5 | 1.7 | — | 0.15 | 0.10 | 0.016 | 0.41 | 23 | Example |
| 12 | 0.028 | 0.3 | 13.6 | 1.7 | — | 0.16 | 0.10 | 0.015 | 0.39 | 48 | Example |

Also, the hot-rolled materials were measured for Brinell hardness (HB) under a load of 3000 kg. Furthermore, standard Charpy impact specimens having a thickness of 10 mm were manufactured, and the 0° C. impact values of the specimens were measured in a longitudinal (L) direction, parallel to the rolling direction (RD), and in a long transverse (T) direction, perpendicular to the rolling direction (RD) in the horizontal plane. The results are given in Table 2 below. As such, the overall hardness and impact values are an average of the three measured values.

Figure 1B:
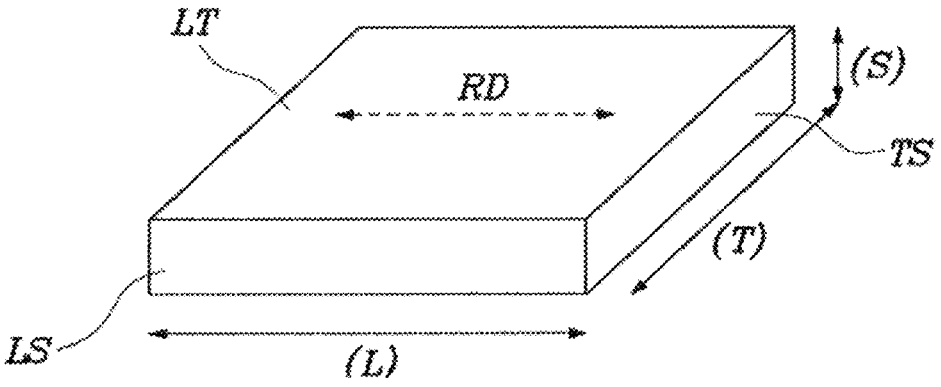
FIG. 1*b* illustrates the planes of the sheet in different directions.

FIG. 1*a* illustrates the impact specimen in different directions, and FIG. 1*b* illustrates the planes of the sheet in different directions. As illustrated in FIG. 1*a*, the impact specimen in a longitudinal (L) direction means that the notch plane of the impact specimen is perpendicular to the rolling direction (RD), and the impact specimen in a long transverse (T) direction means that the notch plane of the impact specimen is parallel to the rolling direction. As illustrated in FIG. 1*b*, the direction perpendicular to the T direction in the vertical plane is referred to as a short transverse (S) direction, the plane of a stainless steel sheet defined by the L direction and the T direction is referred to as an LT plane, the plane of a stainless steel sheet defined by the L direction and the S direction is referred to as an LS plane, and the plane of a stainless steel sheet defined by the T direction and the S direction is referred to as a TS plane.

TABLE 2

| | 0 Impact (J) | | Hardness | |
|---|---|---|---|---|
| # | T | L | HB | Note |
| 1 | 3 | 3 | 382 | Comparative Example |
| 2 | 9 | 11 | 312 | Comparative Example |
| 3 | 3 | 5 | 293 | Comparative Example |
| 4 | 6 | 9 | 298 | Comparative Example |
| 5 | 9 | 9 | 294 | Comparative Example |
| 6 | 21 | 30 | 293 | Example |
| 7 | 21 | 26 | 257 | Example |
| 8 | 20 | 25 | 260 | Example |
| 9 | 30 | 51 | 278 | Example |

TABLE 2-continued

| | 0 Impact (J) | | Hardness | |
|---|---|---|---|---|
| # | T | L | HB | Note |
| 10 | 6 | 7 | 312 | Comparative Example |
| 11 | 20 | 30 | 286 | Example |
| 12 | 27 | 46 | 279 | Example |

As is apparent from [Table 1] and [Table 2], all steels exhibited a high hardness of 250 HB or more. Moreover, Examples (#6 to #9, #11, and #12 in Table 1) according to the present invention showed superior low-temperature impact properties because of impact values higher than 20 J in different directions, under the condition that the FS value was 5 or more. Therefore, an FS of 5 to 50 can be confirmed to be preferable in the present invention.

In Comparative Examples and Examples of [Table 2], the steels of Comparative Examples had L direction impact values, similar to T direction impact values. However, in the steels of Examples, the differences between L and T direction impact values exceeded 5 J.

Using #10 to #12 of [Table 1], changes in impact toughness depending on the ferrite stability value and impact toughness in different directions are described below.

Figure 2:
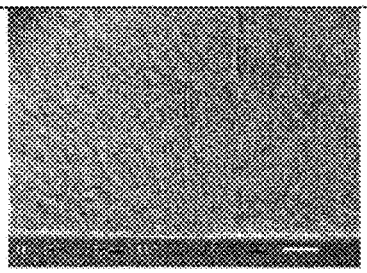
FIG. 2 illustrates images of the fracture surfaces of impact specimens at low temperature (0° C.) of Comparative Examples and Examples according to the present invention.
Figure 2:
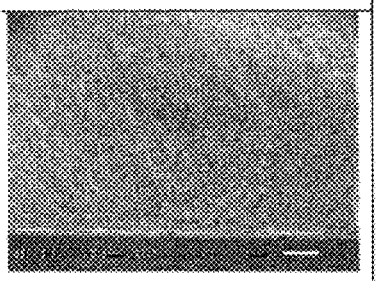
Figure 2:
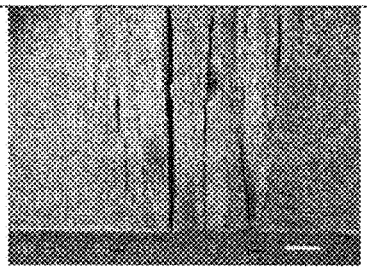
Figure 2:
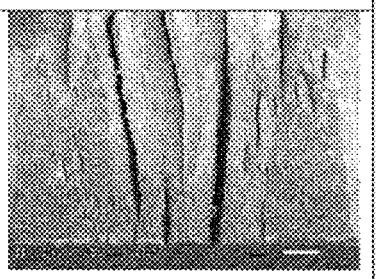
Figure 2:
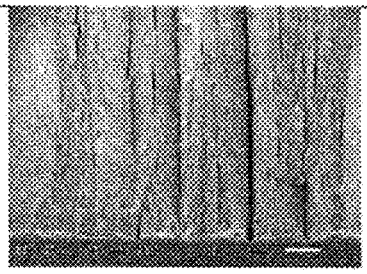
Figure 2:
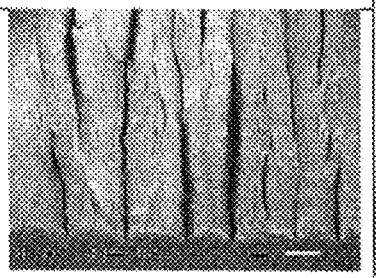

FIG. 2 illustrates images of the fracture surfaces of low-temperature (0° C.) impact specimens of Comparative Examples and Examples according to the present invention. In the steel of Comparative Example (#10), having low ferrite stability (FS), the impact fracture surface was very smooth and could thus be easily confirmed to be a low-energy fracture. However, in the steels of Examples (#11 and #12) having high ferrite stability (FS), a fracture surface having deep flexures formed in the fracture process was observed. Thus, as the ferrite stability (FS) increased, the flexures of the fracture surface became severe, from which the impact energy was increased due to the conversion from brittle fracture to ductile fracture, ultimately increasing impact toughness. As shown in [Table 2] and FIG. 2, low-temperature impact toughness of 20 J or more could be ensured by controlling the ferrite stability (FS) to a predetermined level or more, for example, 5 or more.

Figure 3:
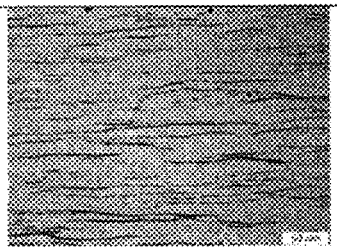
FIG. 3 illustrates images of the microstructures of Comparative Examples and Examples according to the present invention.
Figure 3:
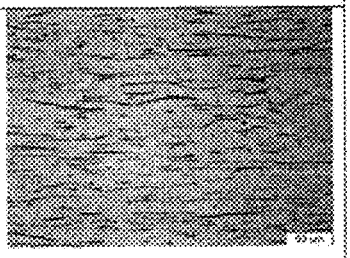
Figure 3:
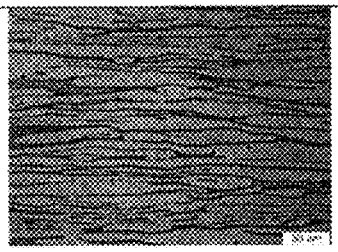
Figure 3:
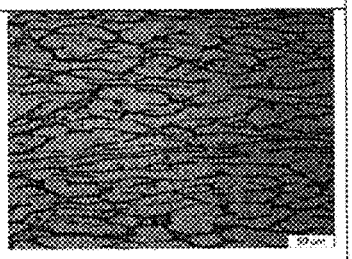
Figure 3:
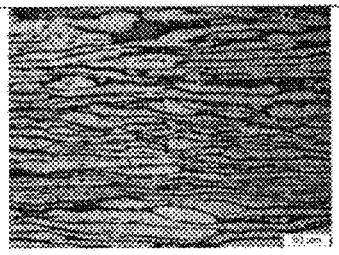
Figure 3:
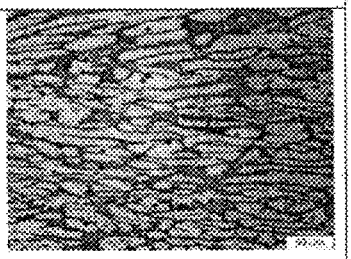
Figure 4:
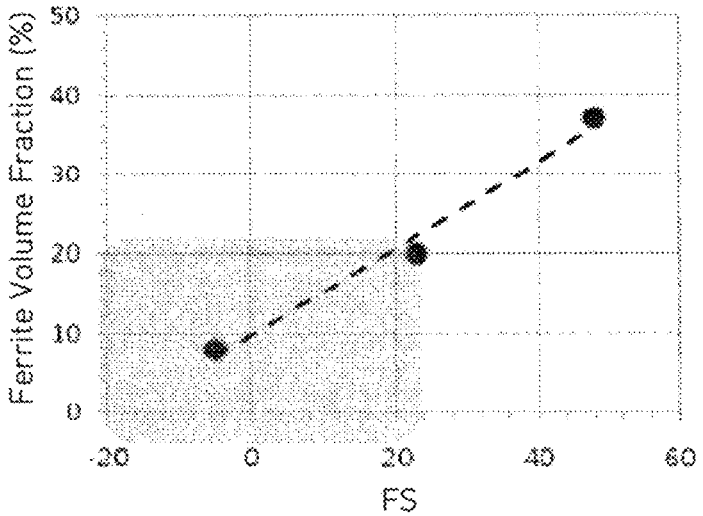
FIG. 4 is a graph illustrating the correlation between the ferrite stability and the ferrite volume fraction.
Figure 5:
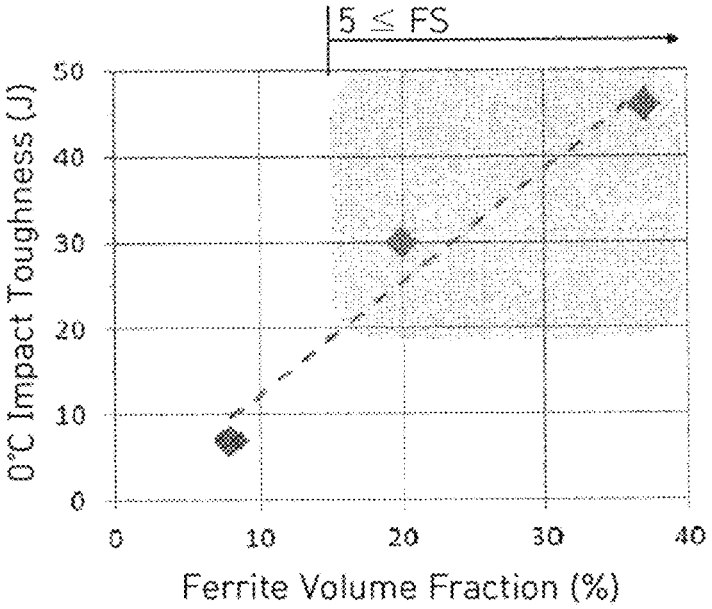
FIG. 5 is a graph illustrating the correlation between the ferrite volume fraction and the low-temperature (0° C.) impact toughness.

FIG. 3 illustrates images of the microstructures of Comparative Example and Examples according to the present invention, FIG. 4 is a graph illustrating the correlation between the ferrite stability and the ferrite fraction, and FIG. 5 is a graph illustrating the correlation between the ferrite volume fraction and the low-temperature (0° C.) impact toughness.

As illustrated in FIG. 3, the black phase in the microstructure image is a ferrite phase, and the matrix structure around the ferrite phase is a high-hardness martensite phase. Compared to the steel of Comparative Example (#10) having low impact toughness in [Table 1], the ferrite fraction of the steels of Examples (#11 and #12) was relatively high. In particular, since the steels of Examples (#11 and #12) have a high ferrite fraction, the ferrite phase is provided in a network form, and the ferrite phase of the TS plane is provided in a dense network form, compared to the LS plane. Thereby, the impact toughness of the steels of Examples is estimated to be high compared to the steel of Comparative Example. In particular, for the same steel, the impact toughness of the TS plane is considered to be greater than that of the LS plane.

FIG. 4 illustrates the ferrite volume fraction increasing with an increase in the ferrite stability (FS), which explains the physical meaning of the ferrite stability (FS) as represented by [Equation 1].

FIG. 5 illustrates the low-temperature (0° C.) impact toughness increasing with an increase in the ferrite volume fraction. The reason why the low-temperature impact toughness increases in proportion to the ferrite volume fraction is that the microstructure of the soft ferrite phase is increased.

Based on the above results, the ferrite stability (FS) is regarded as an important factor that controls the low-temperature impact toughness. Below is a description of the difference between the L direction impact value and the T direction impact value, corresponding to one of the stark differences between Comparative Examples and Examples.

The difference between the L direction impact value and the T direction impact value was less than 5 J in the steels of Comparative Examples having low-temperature (0° C.) impact toughness of 20 J or less, but was equal to or greater than 5 J in the steels of Examples. According to the present invention, wear-resistant steels comprising, as a matrix structure, high-hardness martensite, which has very low impact toughness, can be imparted with higher impact toughness by controlling the anisotropy of the structure. Thus, provided is a method of controlling the microstructure to additionally ensure the stability of the structure.

The quantification of microstructures arranged in the rolling direction is described in ASTM E1268-01 (Reapproved 2007) entitled "Standard Practice for Assessing the Degree of Banding or Orientation of Microstructures". In the present invention, the microstructural banding of the ferrite phase, which is the second phase drawn in the rolling direction, was controlled, and thus the degree of anisotropy was expressed using $\Omega_{12}$ according to ASTM E1268-01.

According to ASTM E1268-01, a completely random distribution structure has $\Omega_{12}$ of 0 (zero), and a fully oriented structure has $\Omega_{12}$ of 1.

The microstructural banding ($\Omega_{12}$) is represented by [Equation 2] below:

$$\Omega_{12} = \frac{\overline{N}_{L\perp} - \overline{N}_{L11}}{\overline{N}_{L\perp} + 0.571\overline{N}_{L11}} \quad \text{[Equation 2]}$$

wherein $N_{\perp}$=number of feature interceptions with test lines perpendicular to the deformation direction, $N_{11}$=number of feature interceptions with test lines perpendicular to the deformation direction, $L_t$=true test line length in mm, and $$N_{L\perp}=N_{\perp}/L_t$$

$$N_{11}=N_{11}/L_t$$

$$\overline{N}_{L\perp}=\Sigma N_{L\perp}/n$$

$$\overline{N}_{L11}=\Sigma N_{L11}/n.$$

The degrees of microstructural banding, $\Omega_{12}$, as represented by [Equation 2], of the steels of #10, #11, and #12 of [Table 1] are shown in Table 3 below.

TABLE 3

| Sample [Table 1] | Classification | Microstructural banding ($\Omega_{12}$) LS plane | TS plane |
|---|---|---|---|
| #10 | Comparative Example | 0.88 | 0.86 |
| #11 | Example | 0.85 | 0.74 |
| #12 | Example | 0.78 | 0.65 |

As is apparent from Table 3, in Comparative Example (#10) of [Table 1], in which the low-temperature (0° C.) impact toughness is 20 J or less and the difference between the L direction impact value and the T direction impact value is less than 5 J, the degrees of microstructural banding were very similar for the LS plane and the TS plane. In contrast, in the steels of Examples (#11 and #12), the degree of microstructural banding of the TS plane was higher than that of the LS plane. Specifically, when the degree of microstructural banding of the TS plane, which is a plane parallel to the notch plane of the L direction impact specimen, is controlled in a random direction, impact toughness can be controlled such that there is a difference between the L direction impact value and the T direction impact value.

In order to improve low-temperature impact toughness in the present invention, the degree of microstructural banding of the TS plane is controlled in the range from 0.60 to 0.80, thus maximizing the ferrite anisotropy difference ($\Delta\Omega$) between the TS plane and the LS plane to thereby increase the L direction impact value. Accordingly, additional impact toughness ($\Delta\Omega$=L direction impact value−T direction impact value) is preferably ensured. For example, in the present invention, the degree of microstructural banding of the TS plane is preferably controlled in the range from 0.60 to 0.80, so that the low-temperature (0° C.) impact value in the L direction is higher by 5 J or more than the low-temperature (0° C.) impact value in the T direction.

To additionally attain impact resistance by controlling the anisotropy of ferrite, various factors, including the re-heating temperature and the reduction ratio in the hot rolling process, as well as the ferrite volume fraction, are regulated, so that ferrite transformation (nucleation and growth) is preferably controlled.

Figure 6:
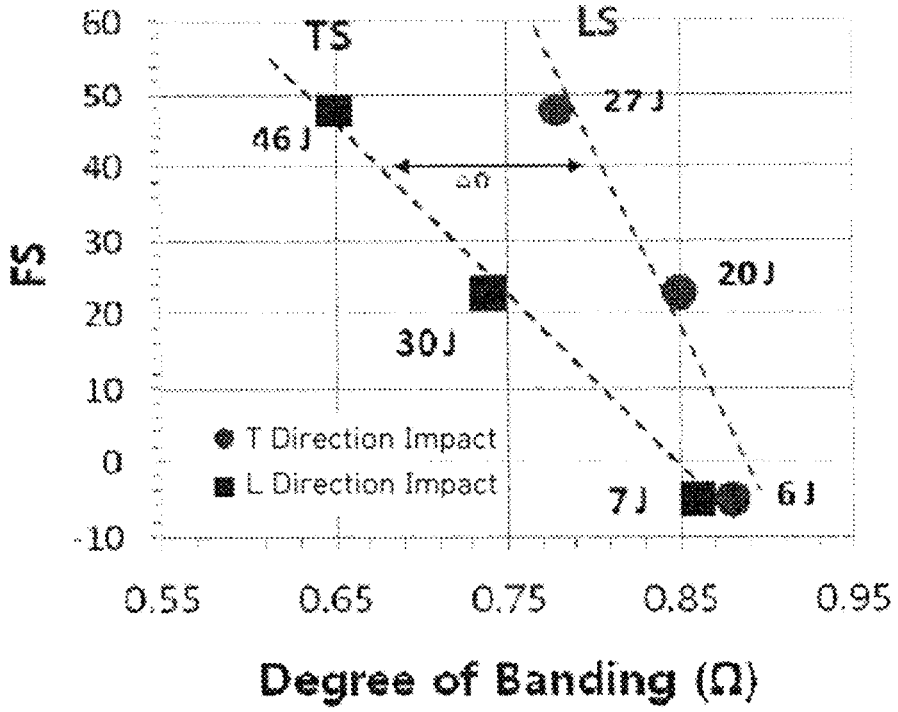
FIG. 6 is a graph illustrating the impact toughness of the impact specimen in different directions, as represented by the function of the ferrite stability and the degree of microstructural banding.

FIG. 6 is a graph illustrating the impact toughness of the impact specimen in different directions, as represented by the function of the ferrite stability and the degree of microstructural banding. As the ferrite volume fraction is increased and the degree of microstructural banding is decreased, steel having excellent low-temperature (0° C.) impact toughness can be manufactured.

According to the present invention, the ferrite volume fraction and the degree of microstructural banding are controlled, making it possible to manufacture high-hardness wear-resistant steel comprising a martensitic matrix structure and a ferrite phase.

Although the preferred embodiments of the present invention have been disclosed with reference to the appended drawings, the present invention is not limited thereto, and is defined by the accompanying claims. Therefore, those skilled in the art will appreciate that various modifications, additions and substitutions are possible, without departing from the scope and spirit of the invention as disclosed in the accompanying claims.

The invention claimed is:

1. A hot-rolled stainless steel sheet having improved hardness and low-temperature impact properties, which is manufactured by steel making, continuous casting and hot rolling, the hot-rolled stainless steel having a longitudinal direction parallel to a rolling direction and a transverse direction perpendicular to the rolling direction, the hot-rolled stainless steel comprising:

0.01 to 0.03 wt % of C, 11 to 14 wt % of Cr, 0.1 to 0.2 wt % of Ti, 0.1 to 0.2 wt % of Nb, 0.01 to 0.03 wt % of N, 0.2 to 0.5 wt % of Si, 0.2 to 2.0 wt % of Mn, 1.0 to 2.0 wt % of Ni, and 0.1 to 0.5 wt % of Mo with the reminder of Fe and inevitable impurities, wherein a sum of amounts of C and N is 0.02 to 0.05 wt %, and a sum of amounts of Ti and Nb is 0.2 to 0.3 wt %, wherein the hot-rolled stainless steel sheet comprises a martensitic matrix structure and a ferrite phase and has a ferrite stability ranging from 5 to 50 as represented by [Equation 1] below, $$FS = -215 - 619C - 16.6Mn + 23.7Cr - 36.8Ni + 42.2Mo + 96.2Ti + 67Nb - 237N + 17.2Si \quad \text{[Equation 1]}$$

where individual components denote amounts of wt % for the corresponding components, and wherein the hot-rolled stainless steel sheet has a first impact value of 20 J or more, the first impact value being measured in the transverse direction at a temperature of 0° C., and a second impact value higher than the first impact value by 5 J or more, the second impact value being measured in the longitudinal direction at a temperature of 0° C.

2. The hot-rolled stainless steel sheet of claim 1, wherein the hot-rolled stainless steel sheet has a Brinell hardness of 250 HB or more in a hot-rolled condition.

3. The hot-rolled stainless steel sheet of claim 1, wherein the hot-rolled stainless steel has a degree of microstructural banding ($\Omega_{12}$) ranging from 0.60 to 0.80 as measured by ASTM E1268-01 at a TS plane defined by a cross-section cut perpendicular to the rolling direction.

4. The hot-rolled stainless steel sheet of claim 1, wherein the ferrite phase has a network form.

* * * * *